US006381847B1

(12) United States Patent
Kanemitsu et al.

(10) Patent No.: US 6,381,847 B1
(45) Date of Patent: May 7, 2002

(54) METHOD OF MANUFACTURING POLY-V-PULLEY

(75) Inventors: Toshiaki Kanemitsu, Kobe; Kunihiro Harada, Miki, both of (JP)

(73) Assignee: Kanemitsu Corporation, Hyogo (JP)

( * ) Notice: Subject to any disclaimer, the term of this patent is extended or adjusted under 35 U.S.C. 154(b) by 0 days.

(21) Appl. No.: 09/647,916

(22) PCT Filed: Oct. 13, 1999

(86) PCT No.: PCT/JP99/01237

§ 371 Date: Oct. 13, 2000

§ 102(e) Date: Oct. 13, 2000

(87) PCT Pub. No.: WO00/54906

PCT Pub. Date: Sep. 21, 2000

(51) Int. Cl.[7] ..... B21K 1/42
(52) U.S. Cl. ..... 29/892.3; 29/892; 72/83
(58) Field of Search ..... 29/892, 892.3; 72/83; 474/169, 170

(56) References Cited

U.S. PATENT DOCUMENTS 3,995,474 A * 12/1976 Kraft ..... 72/83
5,941,113 A * 8/1999 Kanemitsu et al. ..... 72/83

FOREIGN PATENT DOCUMENTS

| | | |
|---|---|---|
| JP | 10-216880 | 8/1998 |
| JP | 10-216881 | 8/1998 |
| WO | WO98/05446 | 2/1998 |
| WO | WO98/05447 | 2/1998 |

* cited by examiner

*Primary Examiner*—P. W. Echols
(74) *Attorney, Agent, or Firm*—Jones, Tullar & Cooper, P.C.

(57) ABSTRACT

The present invention provides a method of manufacturing a poly-V pulley made of metal sheet, which can be easily produced from a thick flat-plate material. By this method, the poly-V pulley is formed to have a two-part arrangement of poly-V grooves having different diameters, i e., a small diameter and a large diameter. A circular flat-plate material having a boss portion at the center thereof is bent, thereby forming a first forming body whose section is dish-shaped. The first forming body includes a supporting base and a conical peripheral portion consecutively disposed so as to be inclined and widened from the outer peripheral end of the supporting base portion in the outward direction. Next, the conical peripheral wall is extended in the widening end direction so as to decrease the thickness thereof, thereby forming a second forming body whose section is also deep dish-shaped. In the extension step, the supporting base portion has great thickness of a flat-plate material without being extended, in order to keep the thickness thereof intact, thus obtaining a boss portion and the supporting base plate, which ensures the necessary joining strength for joining the shaft therewith. Then, the conical peripheral wall of the second forming body, whose thickness is decreased, is drawn, thereby forming a small-diameter cylindrical portion, a stepped portion and a large-diameter cylindrical portion. It is easy to perform a drawing step, because the thickness of the conical peripheral portion has been decreased in the previous step. Finally, the outer peripheral surface of the small-diameter cylindrical portion and the outer peripheral surface of the large-diameter cylindrical portion are provided with poly-V grooves by roll shaping.

7 Claims, 9 Drawing Sheets

METHOD OF MANUFACTURING POLY-V-PULLEY

TECHNICAL FIELD

The present invention relates to a method of manufacturing a poly-V pulley, used for a V-belt for transmitting rotary power.

BACKGROUND ART

A poly-V pulley which is formed into the shape of a two-part arrangement of poly-V grooves, i.e., a small-diameter poly-V groove and a large diameter poly-V groove is known. Generally, such a poly-V pulley is made of cast iron. However, the poly-V pulley made of cast iron is heavy. Moreover, the poly-V groove is formed by a cutting operation, thereby scattering cut powder in the workshop, and worsening the working environment. Furthermore, cutting operations require more time, thereby decreasing efficiency of the work.

An object of the present invention is to provide a method of manufacturing a poly-V pulley made of metal sheet, which has two poly-V grooves having different diameters, i.e., a small-diameter and a large diameter, and which can be produced from a thick flat-plate material Subsequently, the poly-V pulley is more durable, more lightweight and cheaper than the poly-V made of cast iron. Moreover, it can be easily and efficiently produced.

SUMMARY OF THE INVENTION

A method of manufacturing a poly-V pulley including a small-diameter cylindrical portion, a supporting base portion, and a large-diameter cylindrical portion, the small-diameter cylindrical portion having a small-diameter poly-V groove on an outer surface thereof, the supporting base portion having a shaft insertion hole at the center thereof, and the large-diameter cylindrical portion having a large-diameter poly-V groove on the outer surface thereof, which is disposed consecutively and concentrically with the small-diameter cylindrical portion via a stepped portion on the other end in the axial direction of the small-diameter cylindrical portion, comprises the steps of:

bending a circular flat-plate material provided with the shaft insertion hole at the center thereof, thereby forming a first forming body whose section is dish-shaped, including the supporting base portion and a conical peripheral wall consecutively disposed in a widening state from an outer end of the supporting base portion to the outside, extending the conical peripheral wall in the widening end direction, and decreasing the thickness thereof, thereby forming a second forming body whose section is deep dish-shaped, drawing the conical peripheral wall of the second forming body, whose thickness is decreased, thereby forming the small-diameter cylindrical portion and the large-diameter cylindrical portion, and rolling-shaping respectively the small-diameter poly-V groove on the outer periphery of the supporting base portion and the outer surface of the small-diameter cylindrical portion, and the large-diameter poly-V groove on the outer surface of the large-diameter cylindrical portion by means of rolling.

In the method of manufacturing a poly-V pulley according to the present invention, in extending step, only the thickness of the conical peripheral wall is decreased, whereby the supporting base portion is extended so as to keep the great thickness of the flat-plate material intact, thereby producing the supporting base portion having necessary and enough strength so as to engage the crankshaft or the like therein. Moreover, the conical peripheral wall is previously extended, thereby decreasing the thickness thereof so as to draw the small-diameter cylindrical portion and the large-diameter cylindrical portion. Therefore, the drawing process is easily performed. Moreover, the conical peripheral wall is previously bent, whereby it is formed in an inclined and widening state. As a result, the present invention facilitates drawing process in comparison with the case of forming the small-diameter cylindrical portion and the large-diameter cylindrical portion from the flat-plate by direct drawing process.

Such a poly-V pulley made of the metal sheet can be economically, simply and efficiently produced, which is more durable and lightweight than the poly-V pulley made of cast iron.

Moreover, the method of manufacturing a poly-V pulley includes the steps of:

preparing a rotary upper die whose lower end surface is processed as a supporting base portion holding surface, a rotary lower die which is processed so as to have a conical shape with a top surface, namely, which includes a flat supporting base portion receiving surface and a conical slope-like peripheral wall receiving surface, and a side roller, in said extending step, holding the supporting base portion of the first forming body between the supporting base portion holding surface and the supporting base portion receiving surface, mounting the conical peripheral wall of the first forming body on the receiving surface of the peripheral wall, rotating the first forming body together with the upper and lower rotary dies around the axis of the upper and lower rotary dies, while firmly pressing the outer periphery of the side roller against the outer periphery of the conical peripheral wall in the radial direction, rotating the side roller around the axis thereof while moving it to the lower direction of a slope of the peripheral wall receiving surface, and easily extending only the conical peripheral wall in the direction of the widening end in a decreased thickness state.

The poly-V grooves are shaped respectively on the outer peripheral surface of the small-diameter cylindrical portion and that of the large-diameter cylindrical portion by means of rolling through separate steps, thereby shaping the respective poly-V grooves accurately.

Moreover, the employed flat-plate material is provided boss portion disposed at the center thereof, which is protrusively integrated with the flat-plate material. Therefore, the boss portion has the same thickness as that of the flat-plate material in the same way the supporting base portion does, thereby ensuring a sufficient joining strength for joining it with the shaft.

DESCRIPTION OF THE PREFERRED EMBODIMENTS

An embodiment of a method of manufacturing a poly-V pulley according to the present invention will be described with reference to the drawings.

Figure 1:
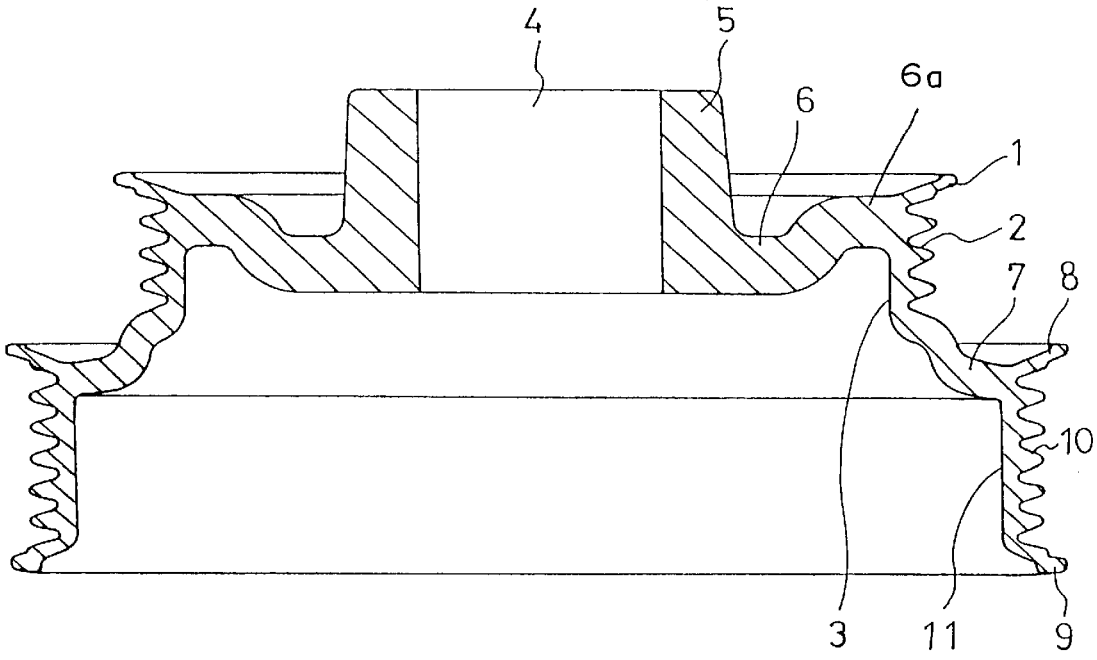
FIG. 1 is a sectional view of a poly-V pulley manufactured according to an embodiment of the present invention.

FIG. 1 is a sectional view of a poly-V pulley manufactured by the embodiment of the present invention. The poly-V pulley comprises a small-diameter cylindrical portion 3 having a first ear portion 1 and a small-diameter poly-V groove 2, a supporting base portion 6 extensively formed from an axial end of the small-diameter cylindrical portion 3 to the radially inward direction thereof and including a cylindrical boss portion 5 protruded outwardly, which has a shaft insertion hole 4 at the center thereof, and a large-diameter cylindrical portion 11 which is connectedly disposed on the axial other end of the small-diameter cylindrical portion 3 through a stepped portion 7, so as to be concentric with the small-diameter cylindrical portion 3, and provided with second and third ear portions 8, 9 and a large-diameter poly-V groove 10 on the outer surface thereof.

The poly-V pulley, for example, is used by inserting the boss portion 5 into a crankshaft. The first ear portion 1, the second ear portion 8, and the third ear portion 9 are slip prevention walls for preventing a poly-V belt from accidentally slipping off the small-diameter poly-V groove 2 and the large-diameter poly-V groove 10 under the condition wherein the poly-V belt hangs on the small-diameter poly-V groove 2 and the large-diameter poly-V groove 10.

Next, the method of manufacturing a poly-V pulley is described with reference to the drawings FIGS. 2A to 2G.

Figure 2A:
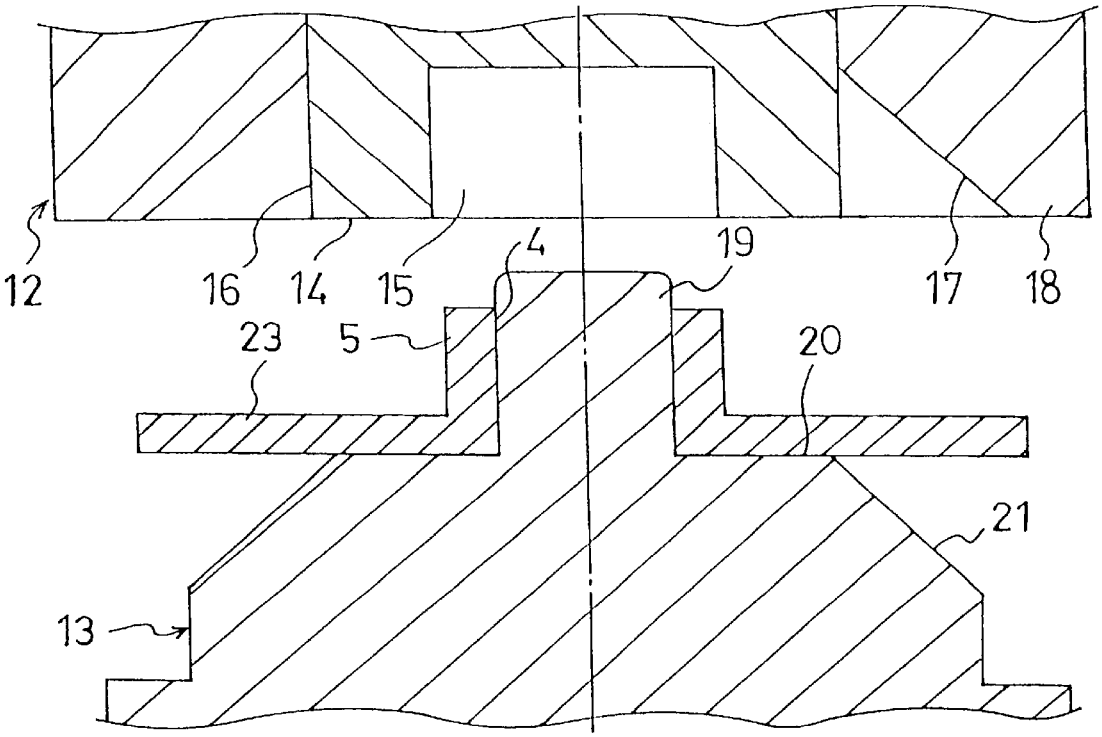
FIGS. 2A to 2G are explanatory diagrams of method of manufacturing a poly-V pulley according to the embodiment of the present invention.
Figure 2B:
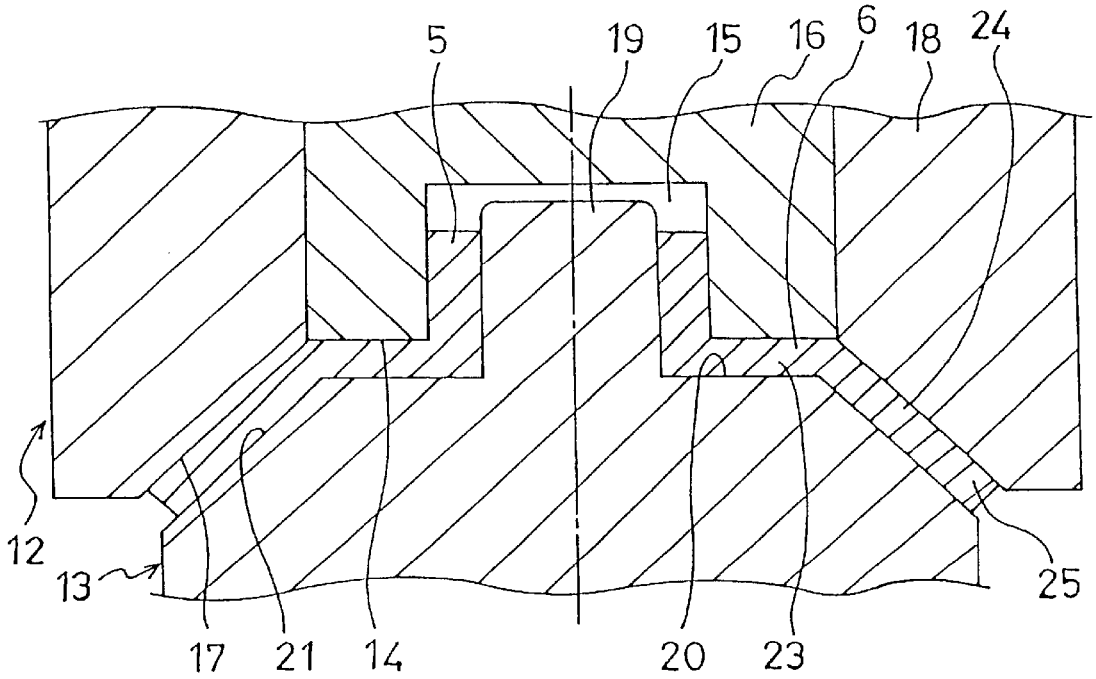

FIGS. 2A and 2B illustrate a bending step performed by means of upper and lower dies 12 and 13 of a press machine. The upper die 12 employed in this step includes an inner member 16 whose lower end surface 14 is processed so as to be a flat surface having a boss portion-clearance recess 15 for receiving a boss portion, on the center of the upper die 12, and a cylindrical outer member 18 having a female typed conical slope surface 17 on an inner periphery of the lower end. The lower die 13 is formed so as to have a conical shape with a top surface. The top surface comprises a flat surface 20 having a protrusion 19 on the center of the lower die 13 and a male type conical slope surface 21.

In this bending step, a circular flat-plate material 23 made of rolling steel plate or the like integrated with the protrusive and cylindrical boss portion 5 having previously a shaft insertion hole 4 on the center thereof is prepared. The boss portion 5 with relation to the flat-plate material 23 is processed by means of burring process or the like.

As shown in FIG. 2A, the boss portion 5 of the flat-plate material 23 is inserted on a projection 19 of the lower die 13. Then, the flat-plate material 23 is placed on the flat surface 20 of the lower die 13. Next, as shown in FIG. 2B, the inner member 16 of the upper die 12 is lowered, an inner area around the boss portion 5 of the flat-plate material 23 by means of the flat lower end surface 14 is strongly pressed against the flat surface 20. Then, the outer member 18 is lowered, thereby pressing an outer area of the flat-plate material 23 against the conical slope surface 21 of the lower die 13 so as to bend it outwardly on the conical slope surface 17 in a widening state. The bending process provides a first forming body 25 whose section is dish-shaped, having the flat supporting base portion 6 including the boss portion 5 on the center thereof and a conical peripheral wall 24 connectedly disposed from the outer end of the supporting base portion 6 to the outside in an inclined state so as to widen toward the end.

Figure 2C:
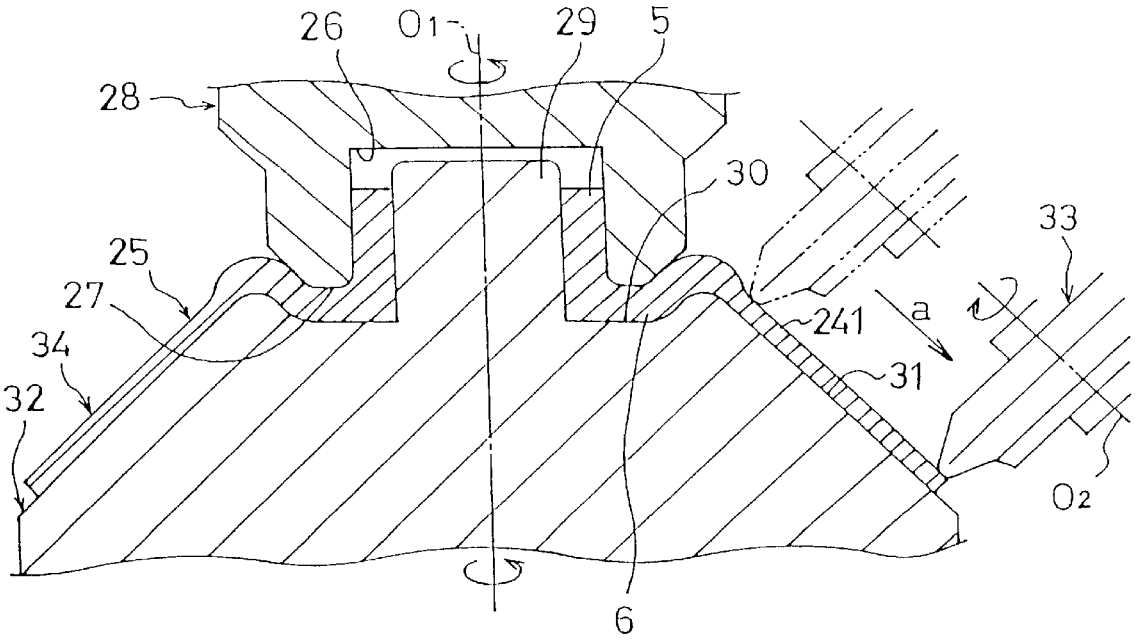

FIG. 2C illustrates an extending step. In the extending step, rotary upper and lower dies 28, 32 and a movable side roller 33 for the extending process are employed. The rotary upper die 28 whose lower end surface is processed so as to be a supporting base portion holding surface 27 having a boss portion -clearance recess 26 for receiving a boss portion, on the center of the rotary upper die 28. The rotary lower die 32 is provided with a flat supporting base portion receiving surface 30 having a protrusion 29 on the center thereof and a conical slope-shaped peripheral wall receiving surface 31, so as to have a conical shape with a top surface.

In the extending step, the first forming body 25 is mounted on the rotary lower die 32 so that the boss portion 5 may be inserted on the protrusion 29, and the supporting base portion 6 is mounted on the supporting base portion receiving surface 30, and the conical peripheral wall 24 is mounted on the peripheral wall receiving wall 31. Then, the rotary upper die 28 is lowered. Subsequently, the supporting base portion 6 around the boss portion 5 of the first forming body 25 is pressed against the supporting base portion receiving surface 30 of the rotary lower die 32 by means of the supporting base portion holding surface 27. Thus, the rotary upper die 28 and the rotary lower die 32 are rotated together with the first forming body 25, around the axis $O_1$ of the rotary upper and lower dies, and the outer periphery of the side roller 33 is strongly pressed against the outer periphery of the conical peripheral wall 24 of the first forming body 25 in the radial direction. While the side roller 33 is rotated around the axis $O_2$ thereof, it is moved to the lower side of the inclined direction of the peripheral wall receiving surface 31 (i.e., the arrow a). The side roller 33 is operated, thereby extending the conical peripheral wall 24 in the direction of the widening end so as to be thinner than the supporting base portion 6, and forming the conical peripheral wall 24 as a reduced thickness-conical peripheral wall 241. In case that the thickness of the supporting base portion 6 is for example 6 mm, the reduced thickness-conical peripheral portion 241 is thinned to substantially 3 mm. The extending process can provide a second forming body 34 whose entire section is deep dish-shaped.

In a previous step disposed before the reduced-thickness conical peripheral wall 241 is thus extended, the outer peripheral portion 6*a* of the supporting base portion 6, as shown in FIG. 1 in a post step, in the outer peripheral portion 6*a* of the supporting base portion 6so as to keep the great thickness of the flat-plate material 23 as it is, or increase the thickness thereof more than the original thickness of the flat-material 23, whereby the first ear portion 1 and the small-diameter poly-V groove 2 can be partially formed.

Figure 3A:
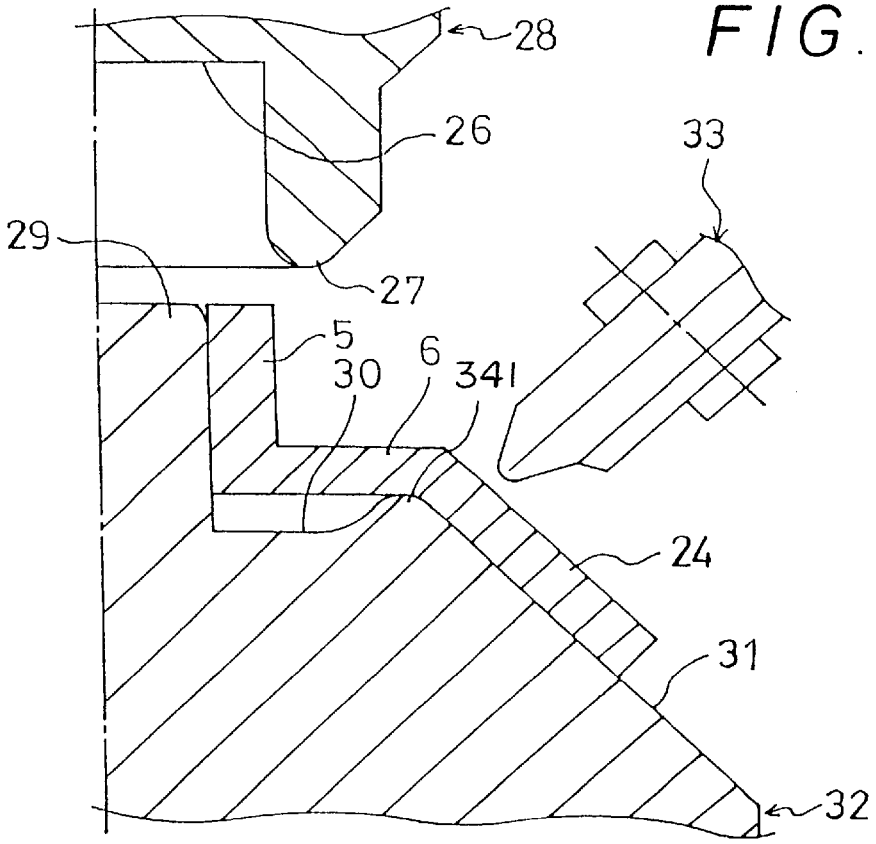
FIGS. 3A and 3B are diagrams of an extending step according to another embodiment of the present invention.
Figure 3B:
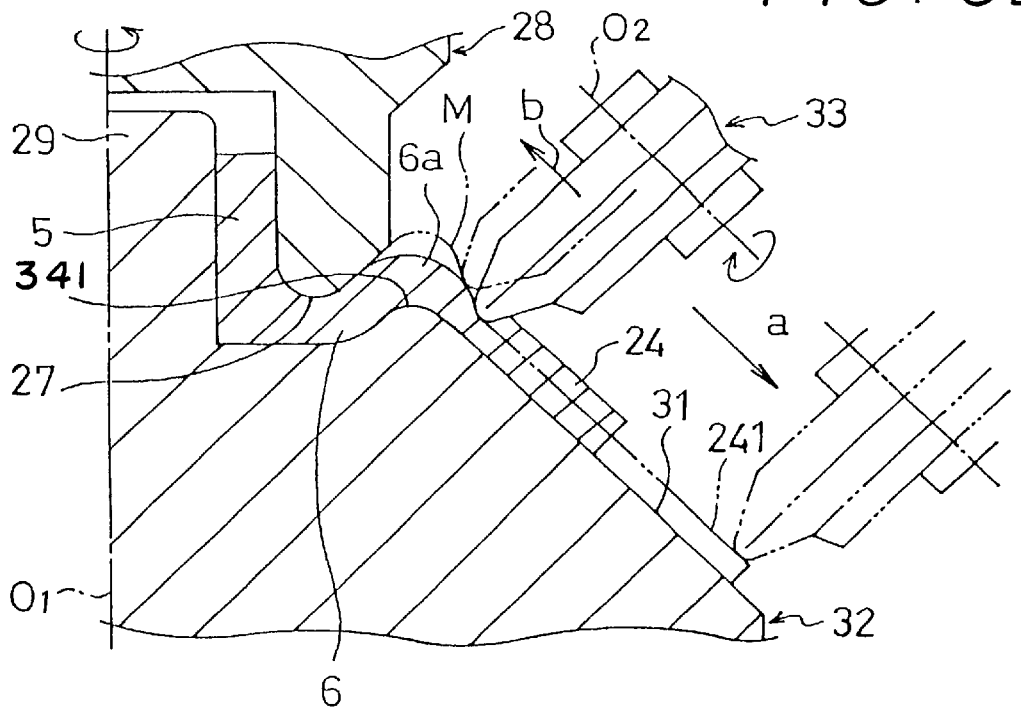

In applying this process, as shown in FIG. 3A, the outer periphery of the supporting base portion receiving surface 30 of the rotary lower die 32 is annularly provided with the protuberance 341. As shown in FIG. 3B, the supporting base plate 6 around the boss portion 5 is pressed against an area between the protrusion 29 and the protuberance 341 by the supporting base portion holding surface 27 of the rotary upper die 28, at the same time while the side roller 33 is strongly pressed against the area close to the upper end, of the outer periphery of the conical peripheral wall 24, whereby the outer periphery 6*a* of the supporting base portion 6 can be bulged in a direction wherein the boss portion protrudes, with keeping the original thickness of the outer periphery 6*a* intact. In this case, the side roller 33 is strongly pressed against the outer periphery 6*a* of the supporting base plate 6, and it is moved to the upper side of the inclined direction of the peripheral wall receiving surface 31, (i.e., the direction of the arrow b in FIG. 3B), thereby bulging the material. Therefore, the outer peripheral portion 6*a* of the supporting base portion 6 makes a thickness increase portion M as a forming foundation of the first ear portion 1 and the small-diameter poly-V groove 2, as illustrated in the assumption line (or two-dot chain line) in FIG. 3B, outwardly extend as much as possible.

Figure 2D:
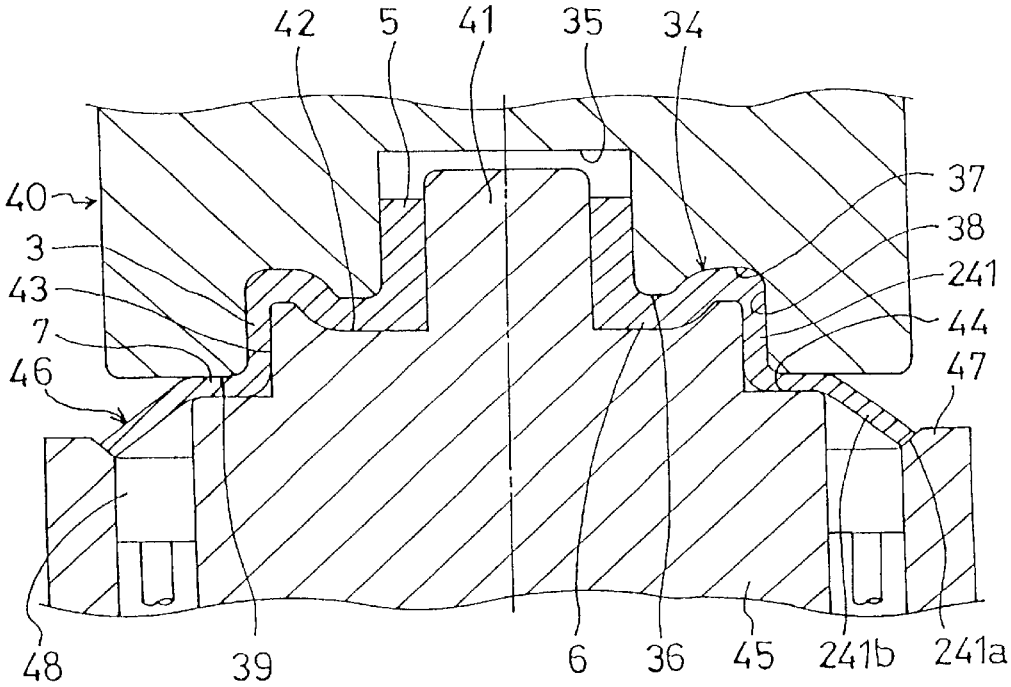

FIG. 2D illustrates a first drawing step. An upper die 40 and a lower die 45 are employed in the first drawing step. The upper die 40 is provided with a boss portion-clearance recess 35 on the center of the lower end surface thereof, and the outer periphery of the boss portion-clearance recess 35 is provided with a supporting base portion holding surface 36. On the outer periphery of the supporting base portion holding surface 36, a recessed groove 37 for engaging the bulged outer peripheral portion 6*a* of the supporting base portion 6 is disposed. Moreover, the outside of the recessed groove 37 is provided with a vertical wall 38 for drawing the small-diameter cylindrical portion. A stepped portion-forming portion 39 is consecutively formed so as to be horizontal from the lower end of the vertical wall 38 to the outside. The lower die 45 is provided with a supporting base portion receiving surface 42 having a protrusion 41 on the center, and a vertical wall 43 for receiving the small-diameter cylindrical portion is consecutively formed so as to be horizontal from an outer end of the supporting base portion receiving surface 42 to the lower side. A stepped portion-receiving surface 44 is consecutively formed so as to be horizontal from the lower end of the vertical wall 43 to the outside.

In the first drawing step, the second forming body 34 is set on the lower die 45, and the upper die 40 is lowered. Then, a substantially upper half of the reduced thickness-conical peripheral wall 241 of the second forming body 34 is drawn between the vertical wall 38 of the upper die 40 and the vertical wall 43 of the lower die 45, thus forming the small-diameter cylindrical portion 3. At the same time, the stepped portion 7 extending from the lower end of the small-diameter cylindrical portion 3 to a radially outward direction is formed between the stepped portion-forming portion 39 and the stepped portion-receiving surface 44. By the first drawing step, a third forming body 46 is obtained.

At that time, the lowest end 241*a* of the reduced-thickness conical peripheral wall 241 is touched with a climb prevention wall 47 disposed on the outer periphery of the lower die 45 so that the lowest end 241*a* may not climb over it. The lower die 45 has a pressing pin 48 for pressing the third forming body 46 upwardly from the lower die 45.

Figure 2E:
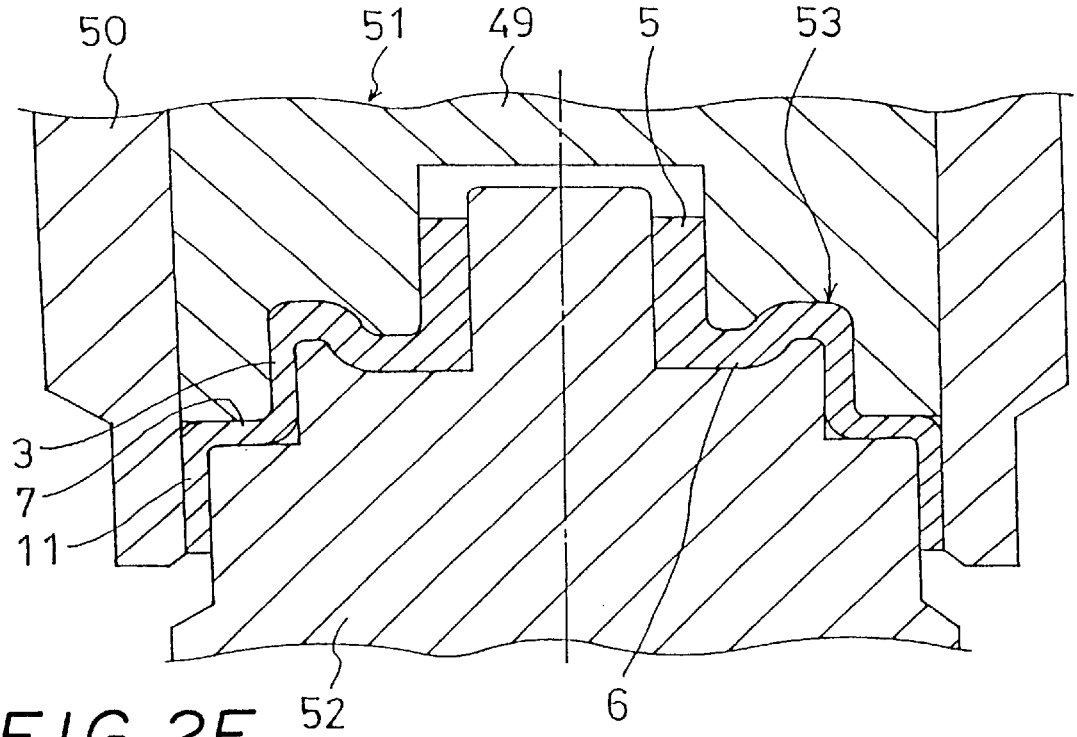

FIG. 2E illustrates a second drawing step. In the second drawing step, an upper die 51 having an upper die body 49 which has the substantially same shape as that of the upper die 40 employed in the first rolling-shaping step, and a large-diameter cylindrical portion drawing die 50 disposed on an outer periphery thereof, and a lower die 52 which has the substantially same shape as that of the lower die 45 employed in the first rolling-shaping step. The third forming body 46 obtained by the first drawing step is put on the lower die 52. The upper die body 49 and the large-diameter cylindrical portion drawing die 50 are lowered, thereby drawing a lower portion 241*b* which is positioned below the stepped portion 7 of the reduced thickness-conical peripheral wall 241. As a result, the large-diameter cylindrical portion 11 is formed. By the second drawing step, a fourth forming body 53 is obtained.

Figure 2F:
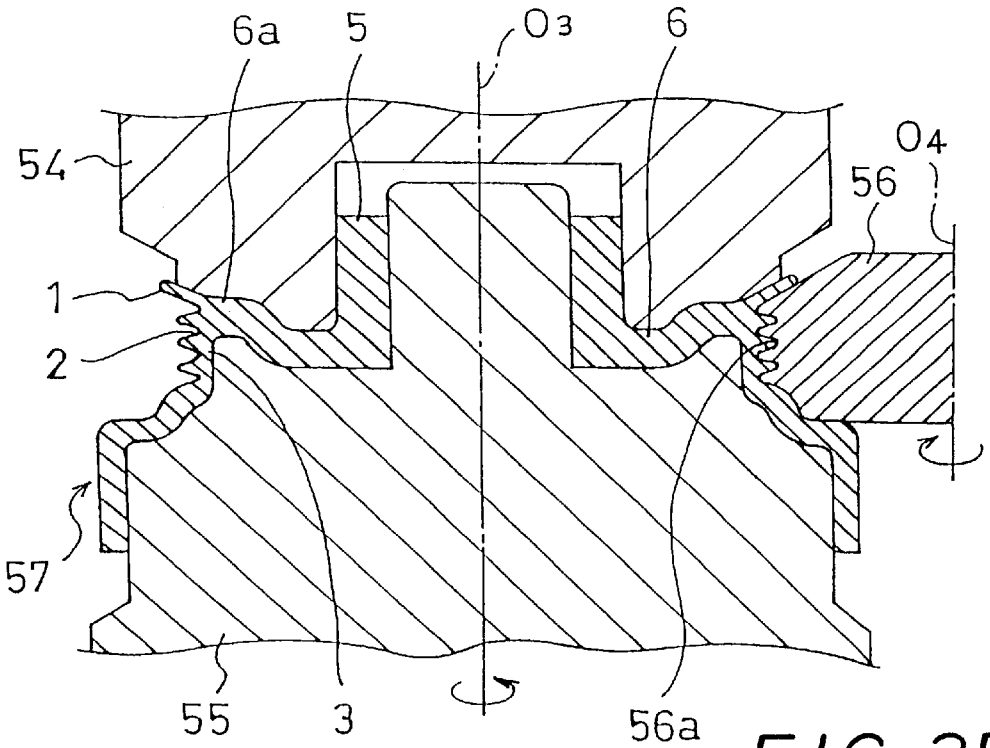

FIG. 2F illustrates a first rolling-shaping step. In this step, the fourth forming body 53 is held between a rotary upper die 54 and a rotary lower die 55, thus rotating around the axis $O_3$ of the upper and lower dies, and an outer periphery 6*a* of the supporting base portion 6 of the fourth forming body 53 and a groove 56*a* of the outer periphery of a first rolling-shaping roller 56 is strongly pressed in the radial direction while the first rolling-shaping roller 56 rotates around the axis $O_4$. Then, on the outer periphery 6*a* of the supporting base plate 6 and an outer peripheral surface of the small-diameter cylindrical portion 3, a small-diameter poly-V groove 2 including the first ear portion 1 and a group of plural V-grooves is shaped. As a process of shaping these first ear portion 1 and small-diameter poly-V groove 2, it is preferable that plural rolling operations are repeatedly performed thereby adjusting a depth and a pit thereof as final measurements in comparison with a case of forming them by only one rolling operation. By the first rolling-shaping step, a fifth forming body 57 can be obtained.

Figure 2G:
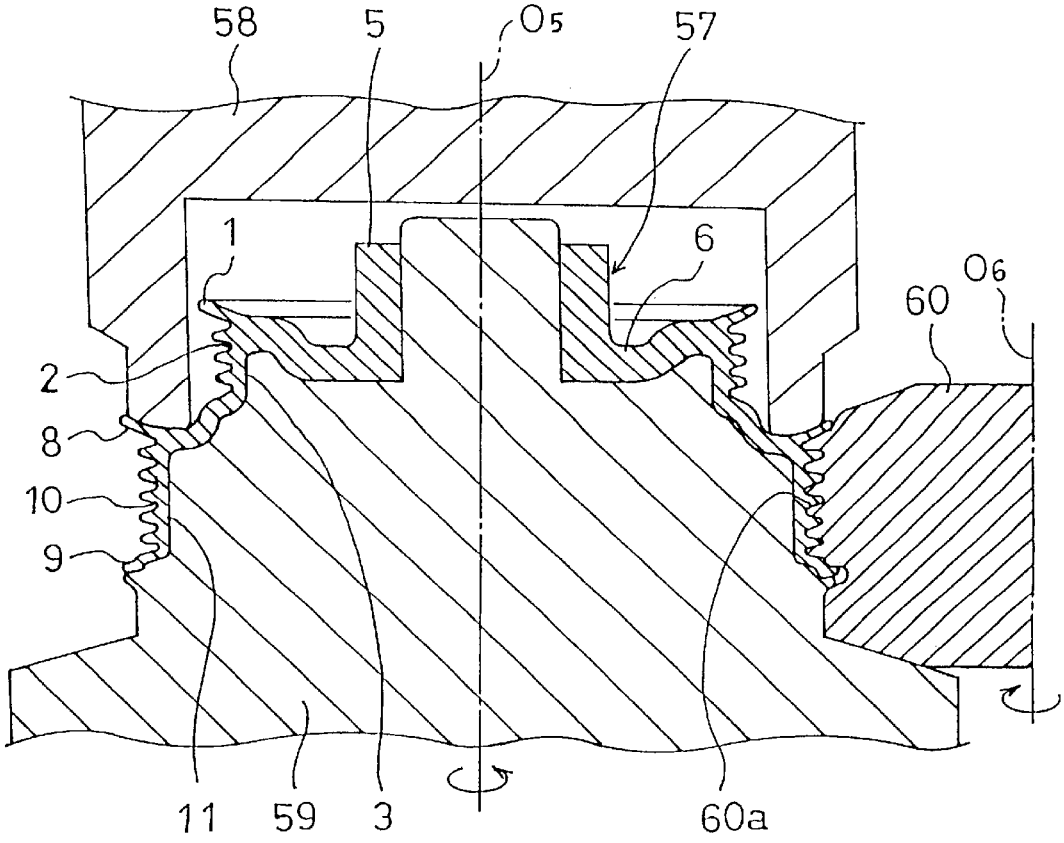

FIG. 2G illustrates a second rolling-shaping step. In the step, the fifth forming body 57 obtained by the first rolling-shaping step is held between a rotary upper die 58 and a rotary lower die 59, thereby rotating around the axis of the upper and lower dies $O_5$, and a groove 60*a* on the outer periphery of the second rolling-shaping roller 60 is strongly pressed against the outer periphery of the stepped portion 7 of the fifth forming body 57 and the outer peripheral surface of the large-diameter cylindrical portion 11 in the radial direction, while the second rolling-shaping roller 60 rotates around the axis $O_6$. Then, on the outer periphery of the stepped portion 7 and the outer peripheral surface of the large-diameter cylindrical portion 11, a large-diameter poly-V groove 10 including the second and third ear portions 8, 9, and a group of plural V-grooves therebetween is shaped. In case of forming the second and third ear portions 8, 9 and the large-diameter poly-V groove 10, it is also preferable that plural rolling operations are repeatedly performed thereby adjusting a depth and a pit thereof as final measurements in comparison with a case of forming them by only one rolling operation, in the same way as the case of forming the first ear portion 1 and of the small-diameter cylindrical portion 3 and the small-diameter poly-V groove 2. By completing the second rolling-shaping step, a poly-V pulley formed into a predetermined shape as shown in FIG. 1 can be obtained.

Figure 4:
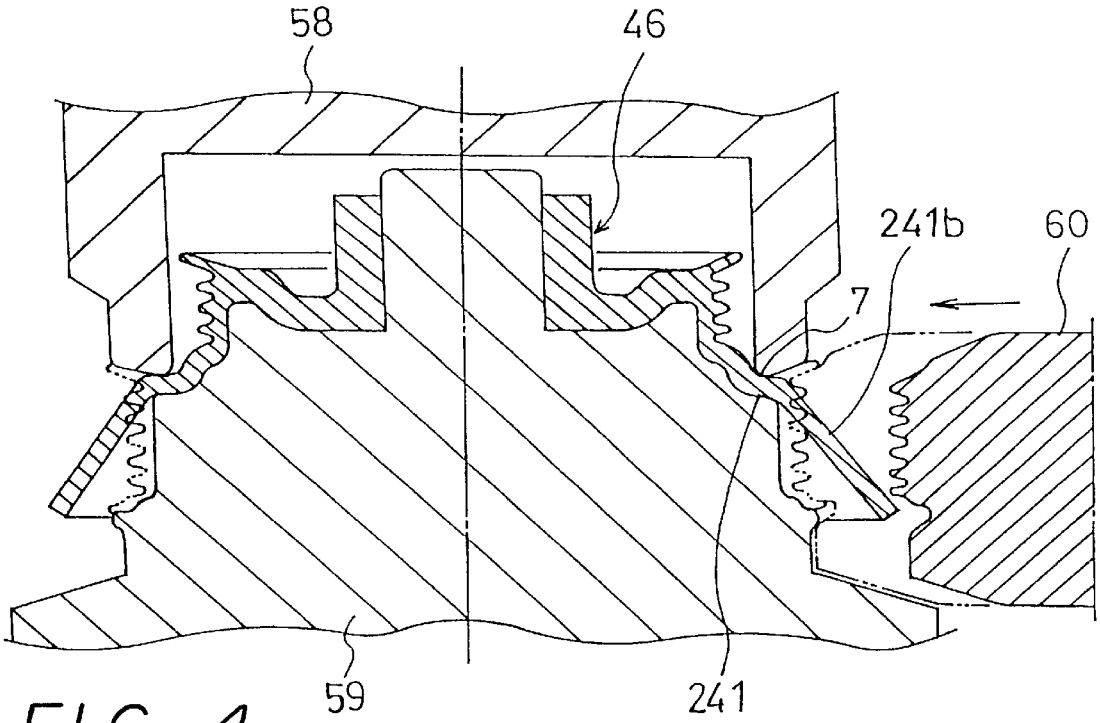
FIG. 4 is a diagram of a second rolling-shaping step according to still another embodiment of the present invention.

In the above embodiment, the second drawing step in FIG. 2E can be omitted and the following step can be adopted. The lower portion 241*b* which is positioned below the stepped portion 7 of the reduced thickness-conical peripheral wall 241 of the third forming body 46 as shown in FIG. 2D is moved to the first rolling-shaping step in FIG. 2F in an inclined state, the first ear portion 1 and the small-diameter poly-V groove 2 are formed on the small-diameter cylindrical portion 3. In the subsequent second rolling-shaping step, the inclining portion 241*b* which is positioned below the stepped portion 7 of the reduced thickness-conical peripheral wall 241 as shown in FIG. 4 is turned to the straight axial direction, by means of a pressing force of the second rolling-shaping roller 60, in order to form the large-diameter cylindrical portion 11, while, on the outer surface thereof, the second and third ear portions 8, 9 and the large-diameter poly-V groove 10 are rolled and shaped as shown in FIG. 2G.

Figure 5:
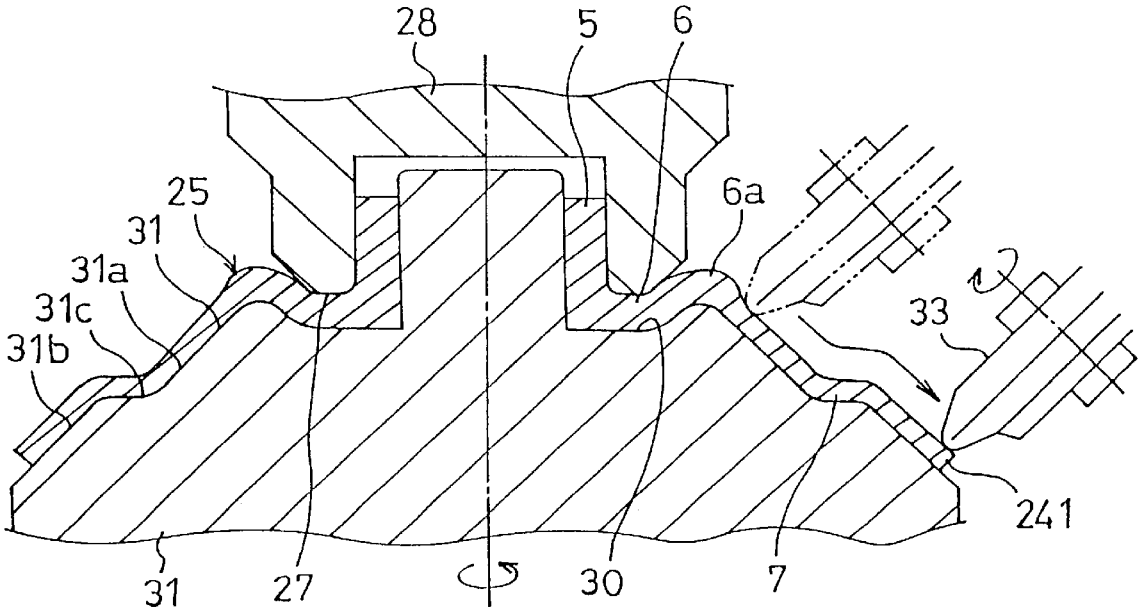
FIG. 5 is a diagram of an extending step according to still another embodiment of the present invention.

If, as the rotary lower die 32 employed in the extending step, the peripheral wall receiving surface 31 of the conical slope surface of the rotary lower die 32 as shown in FIG. 5 is formed as a two-part arrangement including the upper and lower portions i.e., a small-diameter conical surface 31*a* and a large-diameter conical surface 31*b* through a flat link stepped portion 31*c*, the side roller 33 is operated in the same way as the process in the extending step, thereby extending the reduced-thickness conical peripheral wall 241 of the first forming body 25, at the same time while the stepped portion 7 can be preliminarily formed on the flat link stepped portion 31.

As shown in the above embodiment, the first ear portion 1 and the small-diameter poly-V groove 2, and the second and third ear portions 8, 9 and the large-diameter poly-V groove 10 are respectively rolled and shaped on the outer peripheral surface of the small-diameter cylindrical portion 3 and the outer peripheral surface of the large-diameter cylindrical portion 11 in the first rolling-shaping step by means of separate and individual steps. Therefore, the first ear portion 1 and the small-diameter poly-V groove 2, the second and third ear portions 8, 9 and the large-diameter poly-V groove 10 can be respectively and accurately formed so that the number of repeated rolling operations may be decreased. However, it is not limited to this way. A rolling-shaping roller is prepared, wherein the first rolling-shaping roller 56 is integrated with the second rolling-shaping roller 60. By employing the rolling-shaping roller, the first ear portion 1 and the small-diameter poly-V groove 2 are shaped on the outer peripheral surface of the small-diameter cylindrical portion 3, at the same time while the second and third ear portions 8, 9 and the large-diameter poly-V groove 10 are shaped on the outer peripheral surface of large-diameter cylindrical portion 11 by means of rolling.

Figure 6A:
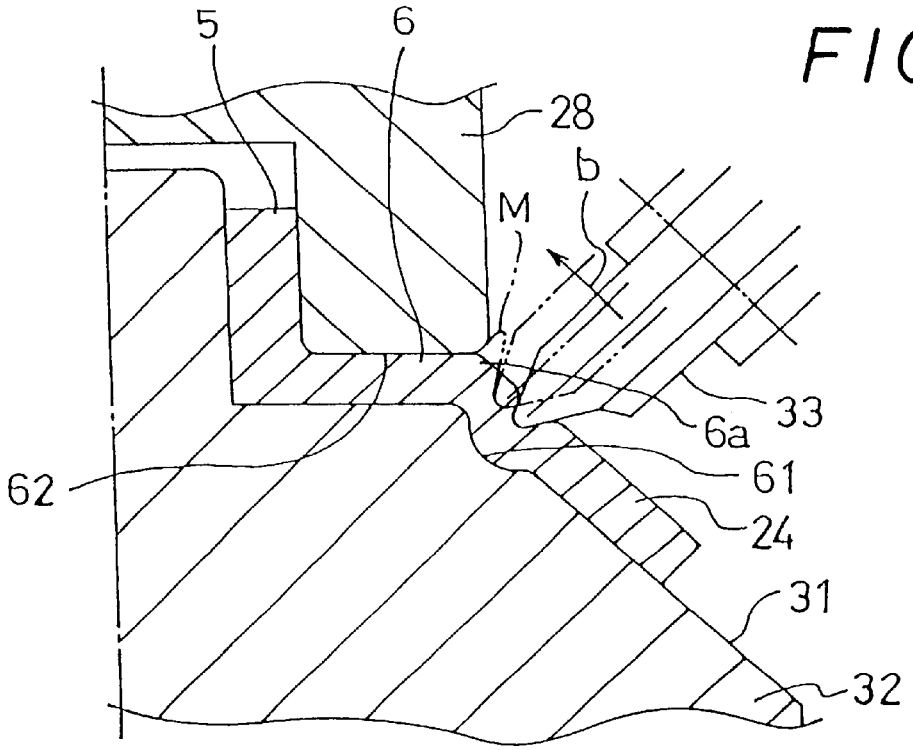
FIGS. 6A and 6B are diagrams of an extending step according to further another embodiment of the present invention.
Figure 6B:
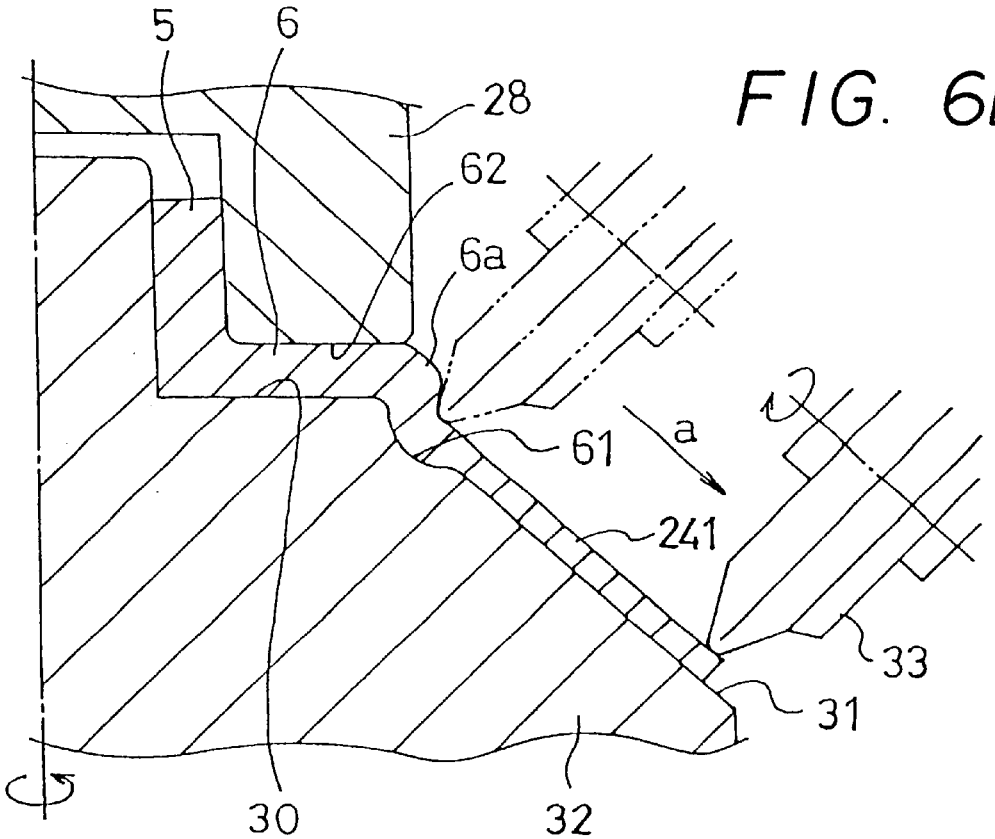

In the extending step, the outer peripheral portion 6*a* of the supporting base portion 6 is processed so that the great thickness of the flat-plate material 23 may be kept as it is, or the thickness of the flat-plate material 23 may be increased. At that time, the recessed groove 61 is circumferentially disposed on the area close to the upper end of the peripheral wall receiving surface 31 of the conical slope of the rotary lower die 32 as shown in FIG. 6A, in addition to the method of the process as shown in FIGS. 3A and 3B. Then, the supporting base portion 6 is pressed against the supporting base portion receiving surface 30 of the rotary lower die 32 by means of the supporting base portion holding portion 62 of the rotary upper die 28, at the same time when the side roller 33 is strongly pressed against the outer peripheral of the portion corresponding to the recessed groove 61 of the conical peripheral wall 24, whereby the outer peripheral portion 6*a* of the supporting base plate 6 can be kept thick. In this case, the portion corresponding to the recessed groove 61 of the outer periphery of the conical peripheral wall 24 is strongly pressed by the side roller 33, and moved in the direction b, thereby raising the material upwardly. As a result, the thickness increase portion M as a foundation for forming the first ear portion 1 on the outer peripheral portion 6*a* of the supporting base portion 6 can be preliminarily projected to the outside, even slightly. Moreover, if the thickness increase portion M as the foundation for forming the first ear portion 1 on the outer peripheral portion 6*a* of the supporting base portion 6 can be preliminarily projected to the outside from an area between the supporting base portion holding portion 62 of the rotary upper die 28 and the side roller 33, even slightly, it can be easy to protrude the first ear portion 1 in the first rolling-shaping step. The outer peripheral portion 6*a* of the supporting base portion 6 is processed so that the great thickness of the flat-plate material 23 may be kept intact, or the thickness of the flat-plate material 23 may be increased more than it. Thereafter, the side roller 33 is moved in the direction a as shown in FIG. 6B, whereby the reduced thickness-conical peripheral wall 241 is extended. This is the same way as the above embodiment.

Figure 7:
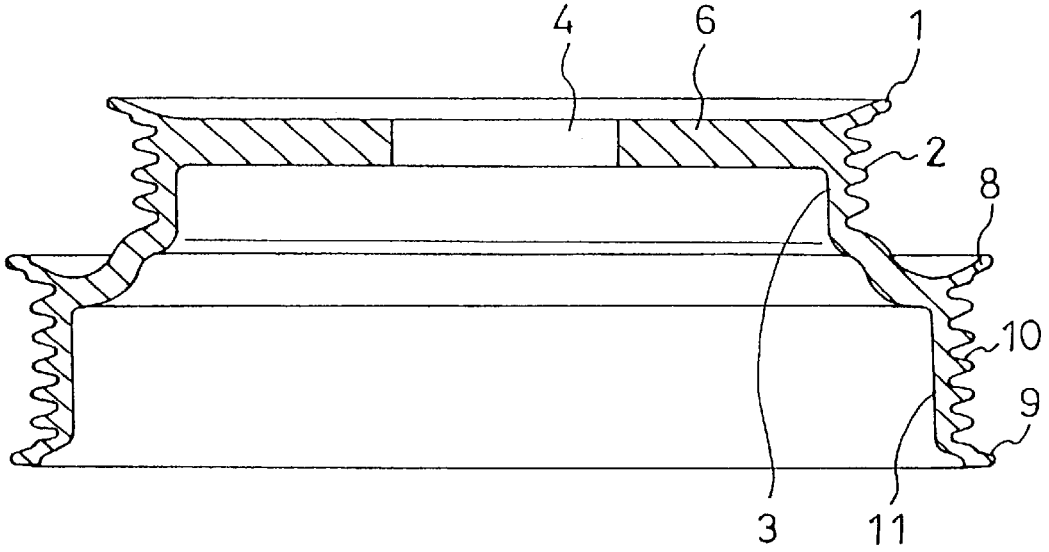
FIG. 7 is a sectional view of a poly-V pulley according to another embodiment of the present invention.

In the embodiment, the boss portion 5 protrudes from the center of the supporting base portion 6 so as to be integrated with the supporting base portion 6. The boss portion 5 has the same thickness as that of the flat-plate material 23 so that the thickness of the flat-plate material 23 may be kept intact, in the same way as the supporting base portion 6. This insures that the joining strength for joining the boss portion 5 with the shaft is sufficient. However, the supporting base portion 6 may be formed in a flat shape without the boss portion 5, so that only the shaft insertion hole 4 may be disposed on the supporting base portion 6, as shown in FIG. 7.

The method of manufacturing a poly-V pulley of the present invention comprises the steps of bending the forming body whose section is dish-shaped, provided with the supporting base portion and the conical peripheral wall, extending only the conical peripheral wall so that only the thickness of the conical peripheral portion may be reduced, with keeping the great thickness of the supporting base portion intact, forming cylindrical portions whose diameter are different by drawing the conical peripheral wall, and rolling-shaping the poly-V groove on each outer peripheral surface of the cylindrical portion having a small diameter and the cylindrical portion having a large diameter. Therefore, the supporting base portion engaged into the shaft can ensure the joining strength so that the thickness of the flat-plate material may be kept as it is, thereby obtaining a strong poly-V pulley, and facilitating drawing cylindrical portions having different diameters, i.e., the large-diameter and small-diameter cylindrical portions in a stepped state. Moreover, processability is superior.

What is claimed is:

1. A method of manufacturing a poly-V pulley including a small-diameter cylindrical portion, a supporting base portion, and a large-diameter cylindrical portion, the small-diameter cylindrical portion having a small-diameter poly-V groove on an outer surface thereof, the supporting base portion having a shaft insertion hole at the center thereof, and the large-diameter cylindrical portion having a large-diameter poly-V groove on the outer surface thereof, which is disposed consecutively and concentrically with the small-diameter cylindrical portion via a stepped portion on the other end in the axial direction of the small-diameter cylindrical portion, comprising the steps of:

bending a circular flat-plate material provided with the shaft insertion hole at the center thereof, thereby forming a first forming body whose section is dish-shaped, including the supporting base portion and a conical peripheral wall which extends outwardly from an outer end of the supporting base portion, and widening in its outward extent, extending the conical peripheral wall in its widening outward extent, and decreasing the thickness thereof, thereby forming a second forming body whose section is deep dish-shaped, drawing the conical peripheral wall of the second forming body, whose thickness is decreased, thereby forming the small-diameter cylindrical portion and the large-diameter cylindrical portion, and roll-shaping respectively the small-diameter poly-V groove on the outer periphery of the supporting base portion and the outer surface of the small-diameter cylindrical portion, and the large-diameter poly-V groove on the outer surface of the large-diameter cylindrical portion.

2. A method of manufacturing a poly-V pulley according to claim 1, further including the steps of:

preparing a rotary upper die whose lower end surface serves as a supporting base portion holding surface, a rotary lower die which is processed so as to have a conical shape with a top surface, which includes a flat supporting base portion receiving surface and a conical slope-like peripheral wall receiving surface, and a side roller, in said extending step, holding the supporting base portion of the first forming body between the supporting base portion holding surface and the supporting base portion receiving surface, mounting the conical peripheral wall of the first forming body on the receiving surface of the peripheral wall, rotating the first forming body together with the upper and lower rotary dies around the axis of the upper and lower rotary dies, while firmly pressing the outer periphery of the side roller against the outer periphery of the conical peripheral wall in the radial direction, rotating the side roller around the axis thereof while moving it to the lower direction of a slope of the peripheral wall receiving surface, and extending the conical peripheral wall in its widening outward extent.

3. A method of manufacturing a poly-V pulley according to claim 2, wherein the poly-V grooves are shaped respectively on the outer peripheral surfaces of the small-diameter cylindrical portion and the large-diameter cylindrical portion by means of rolling through separate steps.

4. A method of manufacturing a poly-V pulley according to claim 2, wherein a cylindrical boss portion is protrusively integrated with the supporting base portion from the center of the supporting base portion to the axially outward direction.

5. A method of manufacturing a poly-V pulley according to claim 1, wherein the poly-V grooves are shaped respectively on the outer peripheral surfaces of the small-diameter cylindrical portion and the large-diameter cylindrical portion by means of rolling through separate steps.

6. A method of manufacturing a poly-V pulley according to claim 5, wherein a cylindrical boss portion is protrusively integrated with the supporting base portion from the center of the supporting base portion to the axially outward direction.

7. A method of manufacturing a poly-V pulley according to claim 1, wherein a cylindrical boss portion is protrusively integrated with the supporting base portion from the center of the supporting base portion to the axially outward direction.

* * * * *

UNITED STATES PATENT AND TRADEMARK OFFICE

CERTIFICATE OF CORRECTION

PATENT NO. : 6,381,847 B1
DATED : May 7, 2002
INVENTOR(S) : Toshiaki Kanemitsu et al.

It is certified that error appears in the above-identified patent and that said Letters Patent is hereby corrected as shown below:

Title page,
Item [22], "PCT Filed: Oct. 13, 1999" should be -- PCT Filed: March 15, 1999 --.

Signed and Sealed this

Thirtieth Day of September, 2003

JAMES E. ROGAN
*Director of the United States Patent and Trademark Office*